United States Patent [19]

Gaucher

[11] Patent Number: 4,537,125

[45] Date of Patent: Aug. 27, 1985

[54] ENDLESS DRIVE BELT APPARATUS FOR PROCESSING CARD TICKETS WITH MAGNETIC TRACK

[75] Inventor: Michel M. G. Gaucher, Le Mesnil Saint Denis, France

[73] Assignee: Electronique Serge Dassault, Paris, France

[21] Appl. No.: 623,959

[22] Filed: Jun. 25, 1984

[30] Foreign Application Priority Data

Jul. 8, 1983 [FR] France ..... 83 11444

[51] Int. Cl.[3] ..... B41J 3/00

[52] U.S. Cl. ..... 101/93.04; 400/635

[58] Field of Search ..... 101/93.04, 93.05, 66, 101/69, 287; 400/629, 635, 124, 129–141

[56] References Cited

U.S. PATENT DOCUMENTS 3,078,789 2/1963 McGee ..... 101/66 X
3,684,076 8/1972 Crain et al. ..... 400/635
4,196,665 4/1980 Rogers ..... 101/66

FOREIGN PATENT DOCUMENTS 947737 5/1974 Canada .
2736788 2/1979 Fed. Rep. of Germany ..... 400/635
2053860 2/1981 United Kingdom .

*Primary Examiner*—E. H. Eickholt
*Attorney, Agent, or Firm*—Christie, Parker & Hale

[57] ABSTRACT

A ticket (1) is driven by an endless belt (10) which is serrated on one surface. The belt engages only a fraction of the width of the ticket. At a print station which includes a dot-matrix print head (145, 146) the ticket passes over a smooth platen roller (150) which includes a portion (152) of reduced diameter in which the belt is received so that its smooth surface comes level with the rest of the cylindrical surface of the platen roller. The print head moves along a generator line of the platen roller, and the roller itself or the drive belt provide the required backing for printing on the ticket.

10 Claims, 5 Drawing Figures

ENDLESS DRIVE BELT APPARATUS FOR PROCESSING CARD TICKETS WITH MAGNETIC TRACK

The present invention relates to apparatus for processing card tickets, eg. tickets for travel or the like.

BACKGROUND OF THE INVENTION

Many modern types of ticket for travel are made on a paper medium which is reinforced to a greater or lesser extent to ensure adequate rigidity. The term "card ticket" is used herein to designate such a medium. As a general rule the ticket also includes a magnetic track. In some cases the ticket further includes lines of weakness to enable one or more tabs to be removed when the ticket is inspected.

Generally speaking, the first step in processing such a ticket is to create a valid ticket from a blank ticket medium. The ticket is subsequently inspected one or more times, and where appropriate, it is cancelled after use.

It is desirable for card ticket processing apparatus to be as simple as possible mechanically, for it to be reliable even when presented with damaged tickets, and, given the typical applications of such apparatuses, for it to be relatively inexpensive. A specific problem lies in obtaining good quality printing on tickets.

Preferred embodiments of the present invention provide improved ticket processing apparatus for processing such a card ticket, and preferably for processing such a card ticket having a magnetic track thereon. That is to say, such embodiments constitute apparatuses for printing on a ticket or on a ticket blank and, where applicable, for reading and/or writing on its magnetic track.

SUMMARY OF THE INVENTION

The present invention provides card ticket processing apparatus including conveyor means for conveying the ticket along a path internal to the apparatus between a ticket inlet and a ticket outlet, and a print station at a first point along the said path for printing on the ticket, said conveyor means including an endless drive belt running round a circuit defined by guide wheels.

The improvement of the present invention lies in that said belt is serrated and co-operates with each ticket over a fraction of the width of the ticket, and said print station co-operates with a smooth platen roller located at said first point along the said path; said smooth roller having a notched portion over which said belt passes, the notched portion being of such a depth that the ticket-contacting surface of the belt is level with the rest of the cylindrical surface of the smooth roller where the belt passes over the roller; said print station being movable transversely relative to the belt to enable it to print on a ticket which is backed by a continuous platen surface which is constituted partly by the smooth roller and partly by the belt where it is level with the roller.

Preferably, said belt provides friction drive for a ticket over the entire length of its path through the apparatus.

It has been found that this mode of driving and printing is highly advantageous. Ticket motion is accurate and without slip, thereby ensuring high quality printing. It should be noted that the ticket on which printing is to take place remains in continuous contact with the drive belt, even while passing the print station.

Another advantage of the above arrangement is that the same basic apparatus can be used to process tickets of differing widths and/or lengths. It appears that tickets are adequately guided by the belt alone, and that lateral guide plates or disks are only necessary for ensuring mechanical cohesion of the apparatus.

In a preferred embodiment of the invention, the serrated belt describes an angle of 160° to 170° wherever it engages a guide wheel along the internal ticket path.

Advantageously, the print station includes a dot-matrix type of print head.

More particularly, the serrated belt is advantageously driven by a stepper motor. It should also pass over an extender wheel situated outside the internal ticket path.

Such card tickets generally include a magnetic track, and the ticket processing apparatus includes a magnetic head for co-operating with the magnetic track on a ticket. In such circumstances, the serrated belt which follows the ticket from the inlet to the outlet takes a detour round a station including the magnetic head and the ticket is driven and urged against the magnetic head by a second belt which co-operates by friction with the said serrated belt. The second belt makes it possible to adjust the pressure with which the ticket is applied to the magnetic head independently of the pressure which required for or due to the motion of the serrated belt.

Both belts are preferably opposite the magnetic track.

BRIEF DESCRIPTION OF THE DRAWINGS

An embodiment of the invention is described by way of example with reference to the accompanying drawings, in which.

MORE DETAILED DESCRIPTION

Figure 1:
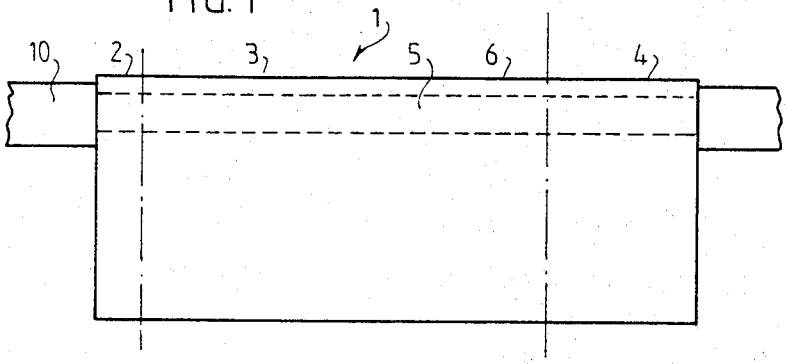
FIG. 1 is a diagram of a card ticket, showing the position of the drive belt 10 relative thereto.

In FIG. 1, the reference 1 designates a travel ticket. The ticket comprises a card blank which may optionally be weakened along two lines to make it easily divided into three portions 2, 3 and 4. The ticket has a magnetic track 5 situated on its face which is not visible in the figure. FIG. 1 also shows how a main drive drive belt 10 is located behind the ticket 1, near to its top edge 6 ("behind" and "top" being relative to the orientations shown in the figure).

Figure 2:
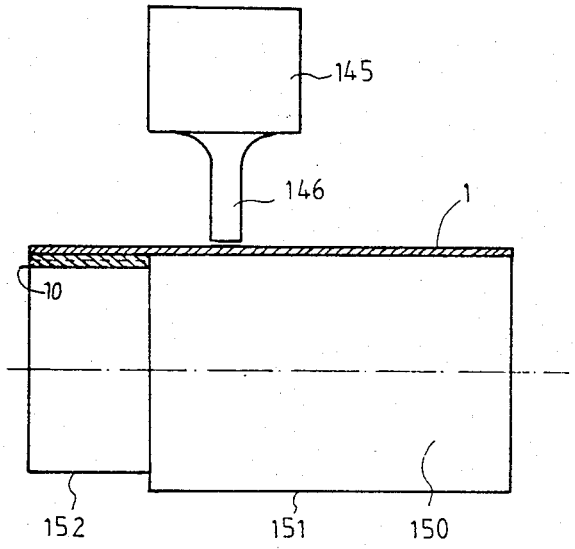
FIGS. 2 and 3 are respectively a cross section through and a side view of a print station.
Figure 3:
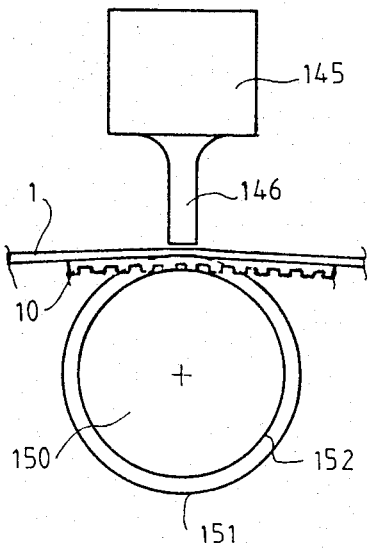

FIGS. 2 and 3 show the ticket 1 being driven through a print station by the drive belt 10. The print station comprises a dot matrix printer including a block 145 having a print head proper 146. The head assembly 145, 146 is movable from one end to the other of a generator line on the surface of a platen roller 150. The platen roller 150 has a smooth outer surface 151 with a smaller diameter notched portion 152 at one end which can also have a smooth outer surface, and which is of such a size as to receive the drive belt 10 so that it is level with the smooth surface of the remainder of the platen roller 150 along the said generator line.

The ticket-contacting face of the drive belt 10 is smooth, but as can be seen in FIGS. 2 and 3 the opposite face of the drive belt is serrated for engaging belt-driving means.

Figure 4:
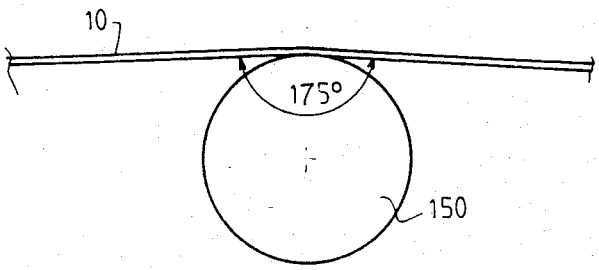
FIG. 4 is a diagrammatic side view showing how the drive belt passes over the print station roller (which is similar to its passage over other guide wheels)

As is explained in greater detail below, the drive belt is kept under tension from both sides of the platen roller 150 in such a manner that there is an angle of about 175° between the directions at which it arrives at and departs from the roller 150 (see FIG. 4). This angle could naturally be slightly different, but it must be less than 180° in order to ensure that the drive belt remains in contact with the roller 150.

Unexpectedly, it turns out that a dot matrix printer of the type mentioned prints properly on a ticket at any point along the entire length of a generator line of the platen roller 150, regardless of whether the ticket is backed directly by the outer surface 151 of the roller, or by the drive belt 10 as supported in the notched portion of the roller.

It is naturally desirable that the serrations on the drive belt 10 should be at a fairly small pitch. Under normal conditions of ticket and print head size, it appears that the pitch should not be greater than 5 mm, and is preferably close to 2 mm.

Figure 5:
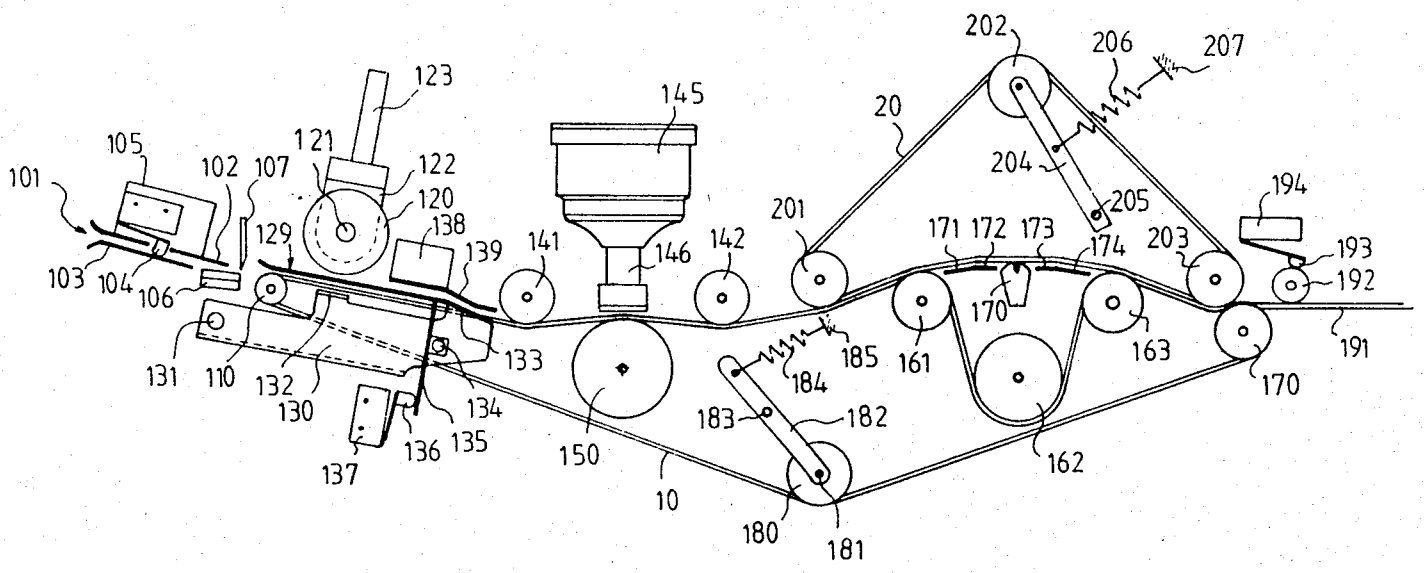
FIG. 5 is an overall side view of a card ticket processing apparatus in accordance with the invention.

Reference is now made to FIG. 5 which shows an embodiment of card ticket processing apparatus in accordance with the invention.

The apparatus is capable both of issuing new tickets and of processing pre-existing tickets.

The apparatus is described initially in operation for issuing a new ticket.

A length of re-inforced paper (ie. a length of "card") is inserted in the apparatus from a supply reel (not shown). The card is inserted via a flared opening to a passage 101 between upper and lower plates 102 and 103. A first microswitch 105 has a feeler 104 projecting into the passage 101 to detect the presence of card therein.

The passage 101 leads to a plate 106 which co-operates with a guillotine blade 107 that is normally in a raised position. The card then passes between the drive belt 10 and an upper plate 129 until its leading edge abuts against a stop plate 135 which is hinged at 134 to a support 130. A second microswitch 137 engages the other end the stop plate 135 by means of a feeler 136 and serves to signal the presence of card abutting against the stop plate. As a result:

(1) The blade 107 is operated to cut off a desired length of card;

(2) A wheel 120 is brought down (the wheel 120 is pivoted at 121 on a support 122 which is itself fixed to the plunger of an electromagnet (not shown)); and (3) The part 130 pivots about the axis 131 which is fixed to a frame for the apparatus (not shown), thereby allowing the ticket blank thus cut from the supply reel to advance along a ticket path internal to the apparatus.

Before describing the rest of the ticket path, it is desirable to describe the dynamics of the ticket conveyor means which comprise the endless drive belt 10 and a plurality of guide and drive wheels over which it runs. At the right hand side of the figure, the drive belt 10 passes round a drive wheel 170 which can be the only wheel on the belt path having teeth to match the serrations on the belt. The belt returns via a lower extensor wheel 180 which pivots on the end of a lever 182. The lever 182 is itself pivoted at 183 on a support (not shown), and is resiliently loaded by a spring 184 which is also fixed to the support at 185. The position of the spring anchor point 185 or the choice of spring 184 enable the tension of the drive belt 10 to be adjusted as necessary. The belt then passes over an inlet wheel 110 after which it begins to follow the internal ticket path. On either side of the platen roller 150 the drive belt 10 is deflected by two respective guide wheels 141 and 142. Then, the belt passes a guide wheel 201, leaves the internal ticket path at a guide wheel 161 to pass round a wheel 162 lying off the path, before returning to the path at a guide wheel 163, and passing a guide wheel 203 before returning to the drive wheel 170.

The drive belt leaves the internal ticket path between the guide wheels 161 and 163 in order to make a detour round a magnetic head 170 which projects into the internal ticket path between a pair of co-planar plates 172 and 173. The sides 170 and 174 of the plates 172 and 173 that are distant from the magnetic head 170 slope away from the common plane towards the magnetic head.

Opposite this arrangement there is a second belt 20. The second belt 20 follows a closed loop around the above-mentioned guide wheels 201 and 203 and round a third guide wheel 202 which is spring loaded in a similar manner to the wheel 180. The second belt is not independently driven and need not be serrated. The guide wheel 201 presses the second belt 20 against the drive belt 10 which sufficient pressure to ensure that a ticket remains in close co-operation with the drive belt, even if that means slipping relative to the second belt 20. Where it passes over the plates 172 and 173, the ticket is driven by the second belt 20 alone which presses the magnetic track against the magnetic head 170. The length of the ticket's path over the magnetic head and plate assembly is short enough to ensure that the ticket remains in contact with the drive belt at all times, and is continuously driven without slipping. In other words, a ticket begins its passage through the magnetic assembly by being pushed forwards from upstream of the guide wheel 161, and it is pressed against the magnetic head by the second belt 20. The second belt 20 is normally moving at the same linear speed as the drive belt and the ticket advances steadily. Before the trailing end of the ticket has left the guide wheel 161, its leading end is picked up by the drive belt at the guide wheel 163. The ticket thus leaves the magnetic station by being pulled by the drive belt 10, and at no time does the ticket completely loose contact with the drive belt.

On the internal ticket path, each time the drive belt passes a guide wheel which pinches the ticket against the drive belt, the belt describes an angle of about 165°. This happens at the guide wheels 141, 142, 201, and 203. The same is preferably true of the second belt where it passes over the guide wheels 161 and 163.

The traction force exerted by friction on the ticket as it passes each guide wheel is regular and little affected by the thickness of the ticket. It is defined almost entirely by the spring 184.

It has been observed that such an arrangement ensures both excellent printing and excellent accuracy in the motion of the ticket and thus of its magnetic track past the magnetic head. Such accuracy in motion is very important to ensure that magnetic characters are properly written on the magnetic track. Another most important feature is the pressure with which the ticket is applied against the magnetic head 170, which pressure is provided by the second belt 20.

The second belt 20 is kept under tension by an extender arrangement comprising the guide wheel 202 which is pivoted at one end of a lever 204 which is itself pivoted to the frame of the apparatus at 205 and is loaded by a spring 206 having an end connected to the apparatus frame at 207. (The frame itself is not shown). The force exerted by the spring 206 is readily set by design, and may optionally be adjustable by adjusting its fixing point 207. The pressure applied by the second belt 20 against the ticket as it passes over the magnetic head 170 can thus be set to a suitable value.

The apparatus described above constitutes a most advantageous solution to the problem of ensuring that a ticket has both visible marks that are legible for people and magnetic marks that are legible for machines.

Both belts preferably engage the ticket immediately opposite the magnetic track.

The entire set of wheels is preferably driven from the single drive wheel 170 as driven by a stepper motor or by a DC motor including tachometer speed control means. The second belt 20 is driven by the drive belt by friction, either directly or through a ticket.

It can be seen in FIG. 5 that the ticket remains in contact with the drive belt 10 from the inlet 101 to an outlet plate 191, which plate has a ticket sensor wheel 192 controlling a microswitch 194 having a feeler 193 which engages the ticket sensor wheel 192.

To issue a new ticket, a suitable length of blank ticket is cut off the supply and is made to advance by the wheels 120, and then 141 and 142 which move it through the print station. The ticket then passes through the magnetic station and the head 170 records information on the reverse side of the ticket in a suitable machine-readable code.

Printing takes place in columns, ie. in the direction which is drawn vertically in FIG. 1. Such point-by-point printing builds up in known manner to produce a plurality of lines of printing on the ticket which are horizontal (again as shown in FIG. 1). The printing could also be done horizontally.

The magnetic information generally correspond to the information printed in the clear together with additional items of information.

After leaving the drive wheel 170, the ticket engages the ticket sensor wheel 192 which serves to inform the apparatus (via the microswitch 194) when the user has taken the ticket. Another new ticket may then be issued, or the drive can be stopped if there is no further work to be done.

Additionally, or in a variant, the FIG. 5 apparatus can be used to process pre-existing tickets.

Such a ticket, or an equivalent document on a plastic medium such as a credit card, is inserted at the outlet 191 where it is detected by the microswitch 194. The belts are initially driven in reverse so that the ticket passes over the magnetic head first where its magnetic recording is read and then through the print station where additional information may be marked thereon in the clear.

The ticket then rides over the deflector 133 and under the cover 139 where its presence is detected, eg. at 138 as it moves over the plate 129. The belts are then reversed (ie. they are driven in the "forward" direction as used for issuing new tickets) and the ticket is returned to the user. Additional marks may be printed thereon and additional information may be recorded thereon magnetically.

The Applicant has used apparatus such as described above to obtain drive accuracy of better than one micron at a maximum drive speed of about 500 mm per second. These figures relate to the motion of the ticket per se. In this embodiment, the drive belt has serrations at a pitch of 2.032 mm and is made of neoprene. The platen roller 150 is 36 mm in diameter.

The ticket used has the shape shown in FIG. 1, being 20 cm by 8 cm. Its magnetic track conforms to ISO standards.

Given these dimensions, it can be seen in FIG. 5 that ticket guidance is provided entirely by its co-operation with the drive belt. Given the length of the ticket, it is essential that it remains continuously in contact between the drive belt and one or two guide wheels. The spaces between the guide wheels 120, 141, 142, 201, 161, 203, and 170 are chosen accordingly.

I claim:

1. Card ticket processing apparatus including conveyor means for conveying a ticket along a path internal to the apparatus between a ticket inlet and a ticket outlet, and a print station at a first point along the said path for printing on the ticket, said conveyor means including an endless drive belt running round a circuit defined by guide wheels, the improvement wherein said belt is serrated and co-operates with each ticket over a fraction of the width of the ticket, and said print station co-operates with a smooth platen roller located at said first point along the said path; said smooth roller having a notched portion over which said belt passes, the notched portion being of such a depth that the ticket-contacting surface of the belt is level with the rest of the cylindrical surface of the smooth roller where the belt passes over the roller; said print station being movable transversely relative to the belt to enable it to print on a ticket which is backed by a continuous platen surface which is constituted partly by the smooth roller and partly by the belt where it is level with the roller.

2. Apparatus according to claim 1, wherein the drive belt is slightly curved where it passes over the platen roller.

3. Apparatus according to claim 1, wherein the serrated drive belt engages and curves round a plurality of guide wheels disposed along the internal ticket path, said ticket passing between the belt and the guide wheels, and successive guide wheels being disposed along the internal ticket path at intervals of less than one ticket length.

4. Apparatus according to claim 3, wherein the belt describes an angle of 160° to 170° where it curves round any one of said guide wheels.

5. Apparatus according to claim 1, wherein the serrated drive belt is driven by a stepper motor.

6. Apparatus according to claim 1, wherein the drive belt is kept under tension by an extender wheel situated outside the internal ticket path.

7. Apparatus according to claim 1, for use with tickets including a magnetic track, wherein the ticket processing apparatus includes a magnetic head for co-operating with the magnetic track on a ticket, wherein the drive belt which follows the ticket from the inlet to the outlet takes a detour round a station including the magnetic head, and wherein the ticket is driven and urged against the magnetic head by a second belt which co-operates by friction with the drive belt.

8. Apparatus according to claim 7, wherein both belts are situated opposite the magnetic track of the ticket.

9. Apparatus according to claim 1, wherein the serrated drive belt has serrations at a pitch of not more than 5 mm, and preferably at a pitch of about 2 mm.

10. Apparatus according to claim 1, wherein said print station includes a dot-matrix printer suitable for printing a column of dots along a generator line of the platen roller.

* * * * *